United States Patent [19]

van den Haak

[11] Patent Number: 4,889,065

[45] Date of Patent: Dec. 26, 1989

[54] METHOD OF TENSIONING AN ANCHOR LINE, IN PARTICULAR FOR TESTING AN ANCHOR, AND A DEVICE FOR CARRYING OUT THE METHOD, PARTICULARLY COMPRISING A CABLE OR CHAIN STOPPER

[76] Inventor: Rob van den Haak, Allegro 114, 2925 BG Krimpen a/d Ijssel, Netherlands

[21] Appl. No.: 147,664

[22] Filed: Jan. 25, 1988

Related U.S. Application Data

[63] Continuation of Ser. No. 45,783, Apr. 29, 1987, abandoned, which is a continuation of Ser. No. 722,789, Apr. 12, 1985, abandoned, which is a continuation of Ser. No. 443,951, Nov. 23, 1982, abandoned.

[30] Foreign Application Priority Data

Nov. 23, 1981 [NL] Netherlands ..... 8105294

[51] Int. Cl.[4] ..... B63B 21/24

[52] U.S. Cl. ..... 114/293; 114/294

[58] Field of Search ..... 114/199, 200, 293/295, 114/299, 230; 43/17.2; 254/144, 217, 222

[56] References Cited

U.S. PATENT DOCUMENTS

| | | | |
|---|---|---|---|
| 632,238 | 9/1899 | Christensen | 114/230 |
| 3,111,926 | 11/1963 | Shatto | 114/230 |
| 3,395,668 | 8/1968 | George | 114/230 |
| 3,620,181 | 11/1971 | Naczkowski | 114/230 |
| 4,067,287 | 1/1978 | Sabella | 43/17.2 |
| 4,090,462 | 5/1978 | Mount | 114/293 |
| 4,186,464 | 2/1980 | Sandoy | 114/230 |

*Primary Examiner*—Joseph F. Peters, Jr.
*Assistant Examiner*—Clifford T. Bartz
*Attorney, Agent, or Firm*—Ladas & Parry

[57] ABSTRACT

A method for pulling an anchor line through a pretensioner adapted to act as a cable or chain stopper and to be deeply submerged so that the line is tensioned at a favorable low incline with respect to the ocean bottom.

4 Claims, 5 Drawing Sheets

METHOD OF TENSIONING AN ANCHOR LINE, IN PARTICULAR FOR TESTING AN ANCHOR, AND A DEVICE FOR CARRYING OUT THE METHOD, PARTICULARLY COMPRISING A CABLE OR CHAIN STOPPER

CROSS REFERENCE TO RELATED APPLICATION

This is a continuation of co-pending application Ser. No. 045,783 filed on Apr. 29, 1987 which is a continuation of Ser. No. 722,789 filed Apr. 12, 1985 which is a continuation of Ser. No. 443,951 filed Nov. 23, 1982 (all now abandoned).

BACKGROUND OF THE INVENTION

This invention relates to a device for and a method of tensioning an anchor line, particularly for testing the anchor.

Heretofore, anchor testing was done by hauling an anchor line at the angle it would lay out in use, calculated according to a catenarian curve formula, by the force of a winch, the propelling means of a ship, or other means.

The disadvantages of said known method are that the tensioning was not positively defined, for example due to drifting of the ship, and that, for the calculated lay out angle, much line had to be payed out and thereby, moreover, the pulling force exerted was not greatly increased, i.e. there was little mechanical advantage.

SUMMARY OF THE INVENTION

Objects of the present invention are to make the pulling force more defined and to increase it to a much higher value than could be obtained heretofore.

This is effected in that the anchor line is passed, i.e. extends through an anchored one way device, which passes the anchor line in the tensioning direction but blocks its return in the opposite, tension-relieving direction.

The one way device preferably comprises a cable or chain tensioner which can be paid out to an underwater location by the anchor winch and fastened to one or more lines which are laid out and anchored in counterpart to the anchor line. The line tension is thus better maintained, as drift of the ship can exert but little further influence on the resulting, more vertically extending anchor line, and the pulling angle at which the anchor line extends from the anchor is smaller, so that the anchor is also more favorably loaded.

Thus, the invention also comprises a method of running an anchor line, in particular for testing the holding power of its anchor, characterized in that the anchor line is threaded through a one way device which is lowered underwater and fastened to one or more lines which are laid out and anchored in counterpart to the anchor line so that the anchor line will be at a reduced angle to the water bed.

The device for carrying out the method is characterized by the tensioner through which the anchor line is passed. In the embodiment for use with a chain, the tensioner has a spring pawl which resiliently moves out of the way of a chain link when the chain moves in the tensioning direction and then again resiliently moves back before the subsequent chain link.

In the embodiment for use with a cable, the tensioner has one or more cable biasing means having cams over which a spring pawl may resiliently pass when the cable moves in the tensioning direction but at which blocking occurs when moving in the opposite direction, and in its preferred embodiment, a sleeve in which the one or more pawls are pivotally mounted. An accurate tensioning action is thereby to be provided in that the cable tensioner has a series of cams for a stepwise tensioning action while each time releasing the pawl, which stepwise tensioning action takes place by remote control of the pawl for each time releasing it. The tension rate is further controlled by a tension limiting means to be connected to a cable or chain tensioner.

The invention is described in more detail with reference to the drawing, in which the invention is illustrated.

DESCRIPTION OF THE PREFERRED EMBODIMENTS

Figure 1:
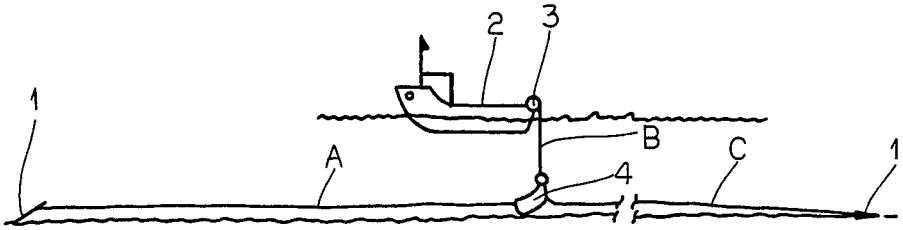
FIG. 1 illustrates the new method of laying out and tensioning an anchor line.

When testing anchors it was until now only possible to bring anchors, as indicated here in FIG. 1 with reference numeral 1, under tension whether by means of the pulling force of the propeller of a ship, indicated at 2 in FIG. 1, or by hauling with the winch 3.

Special provisions always had to be made.

A force of up to 300 tons was exceptional. To obtain in a simple manner a high pulling force, the principle of strapping a rope about a package is used. The arrangement is as illustrated in FIG. 1

To arrive at a high horizontal pulling force, first by means of the chain tensioner 4 line AB is pulled taut through the chain tensioner 4. When the tension is so greatly increased that the vertical pulling force of the crane (or the workship) is exceeded, then line AB tends to return through the chain tensioner 4. Arranged in the chain tensioner 4, however, is a device which will block the return of the line AB automatically. The winch 3 can pull vertically until the maximum strength of the line AB is reached. If the winch 3 has a hoisting capacity of 100 tons, then by means of the formula relating to a catenary, it is possible to calculate what the horizontal components of the forces will be, or they can be measured directly (for example $10\times100=1000$ t). To limit the maximum pulling force, on line part B a breakline (not shown) designed for this maximum is to be connected. It is fastened to an eye on the cable or chain tensioner and cooperates with a blocking pawl preventing the further passage of the line.

Uses

In the single point mooring arrangement for large tankers, which are used offshore typically, the six anchors by which the single point mooring arrangements are anchored, are to be pretensioned. It will then be ensured that the anchors indeed do what they have to do. Presently this is accomplished for example by the workship, which has laid the anchors and chains, itself.

The pulling force of the propellers of these ships is, however, generally not higher than from 100 to 120 tons, whereas normally much higher pretension forces are demanded.

The tendency will be in the years to come towards much higher pretension forces, viz. 500 to 1000 tons and even higher. A hydraulic pulling arrangement on very large (thus expensive) ships also offered a solution. The workships which generally have winches of capacities of 100 to 120 tons on board, can now easily reach these very high holding rates by means of the chain tensioner. Although Stevin anchors according to Dutch patent 151 034 in principle cannot be pulled up to a pulling angle in the range of 6 to 8 degrees, now by means of the chain pretensioning principle they can be pulled to 45 degrees or even higher.

Two anchor lines A and C enables the invention to provide a high holding rate. It is shown in FIG. 1 that the line B extending between the device and the winch 3 is positioned substantially upwardly during operation of the device. One of the most important uses in this field can be anchoring at very great depths. Pretensioning an anchor at a depth of 1800 meters, such as with the OTEC (Ocean Terminal Energy Convention), will meet very great objections, because the tension line should pull substantially horizontally on the anchor. This line will then become unacceptable long and unmanageable.

The principle of the chain tensioner 4 works as follows (see FIG. 1A):

Chain tensioner 4 is fixedly connected to anchor J1 by means of line H.

Figure 2:
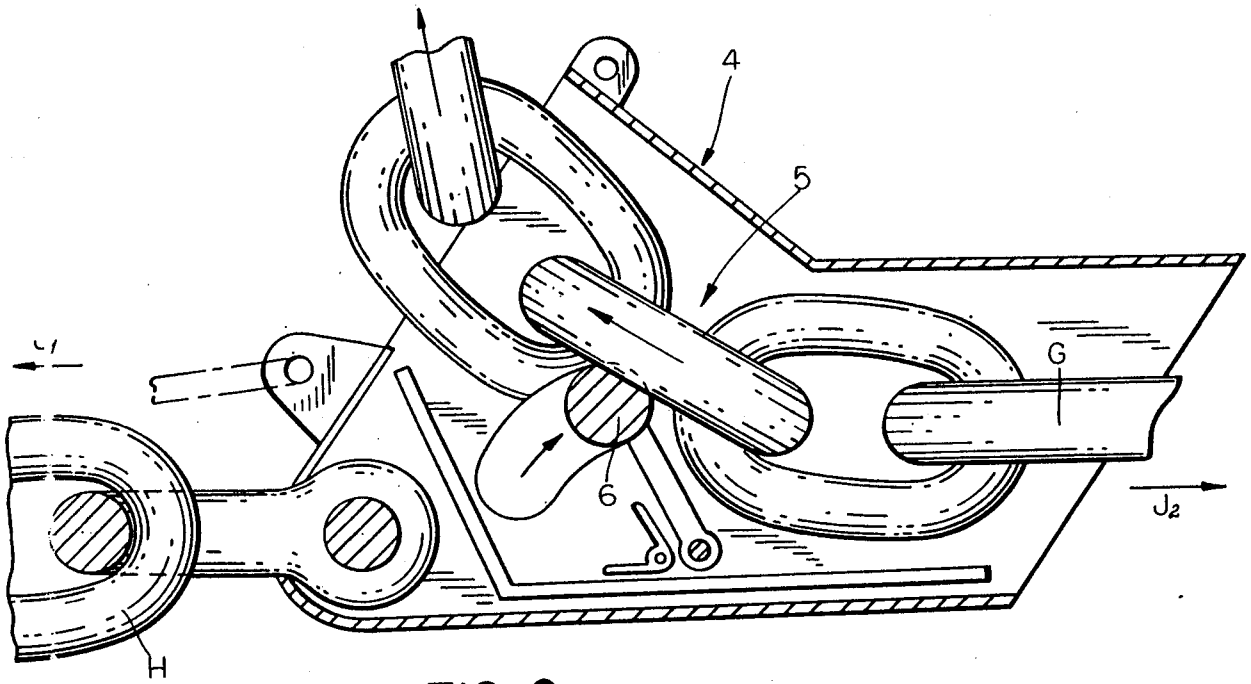
FIG. 2 is a schematic representation of the new chain tensioner.

Anchor J2 is pulled by chain G through the chain tensioner 4. When the force in chain part B becomes smaller than the force in H, then the chain G or 5 (in FIG. 2) tends to return. This is prevented by pawl 6 which by means of a spring automatically snaps out. For the anchor mooring installation the obtainment of high pulling forces is very important.

Figure 1A:
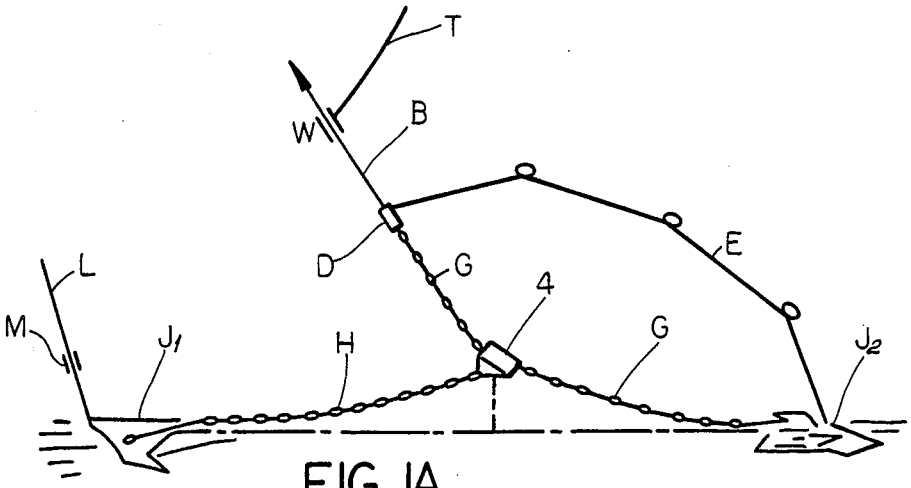
FIG. 1A is an operational scheme.
Figure 3:
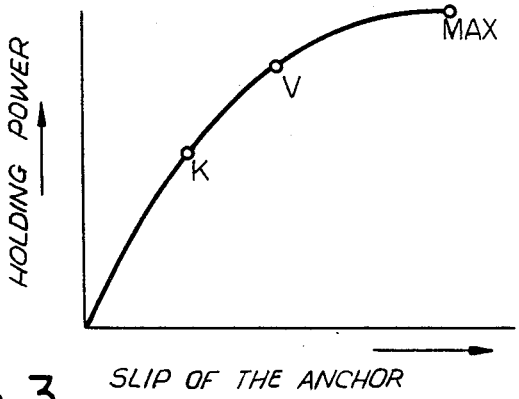
FIG. 3 represent an anchor curve.

In FIG. 3 an anchor curve is sketched. Horizontally the slip of the anchor (the slipping motion of the anchor on the sea bottom under the pulling force, which is a small distance over which the anchor may be hauled) is plotted and vertically the holding power. The holding power is limited to a maximum at continuous slip. To limit the slip, one should be far here under, for example point V which is reached at half the slipway. When pretensioning to point V, then the anchor will slip only when exceeding the holding force V. Point K may then be considered as perfectly safe. The anchor will remain in position and will not slip under the pulling force. At great depth it is, without pennant-wires, no longer possible to break out and pull up the anchor again. Accordingly there will always have to be one pennant-wire on one of the two anchors. This can be prevented by the method represented in FIG. 1A. To release pennant-wire L, a disconnecting ring M is slipped down the line, which as FIG. 1A shows disconnects the wire L. To now pull up the anchor system again, a pennant-wire catch mechanism W is slipped down along the mooring line on a wire T; it catches ring D, whereupon T and W pull the wire E to above and haul the anchor J2 out of the ground. When pulling out, the complete system will now also haul anchor J1 out of the ground.

Figure 4A:
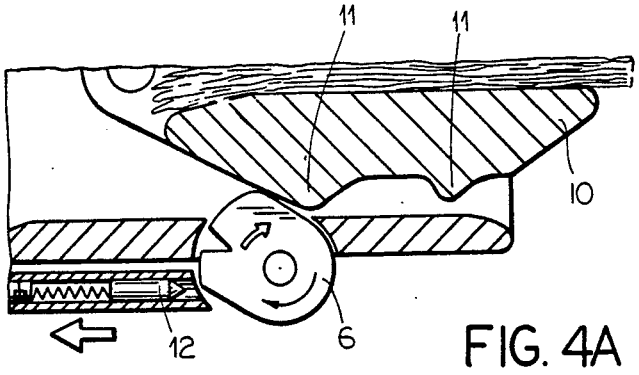
FIGS. 4A and 4B schematically show the construction and operation of the new cable tensioner.
Figure 4B:
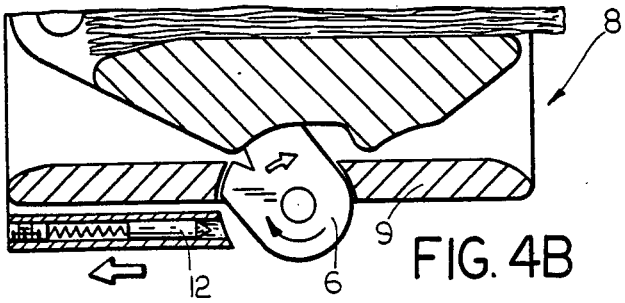
Figure 4C:
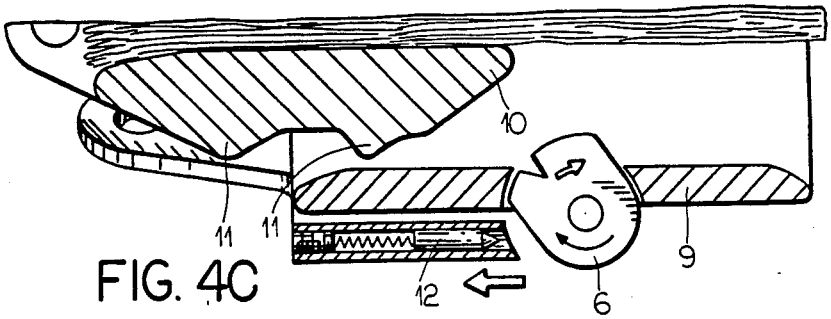
Figure 4D:
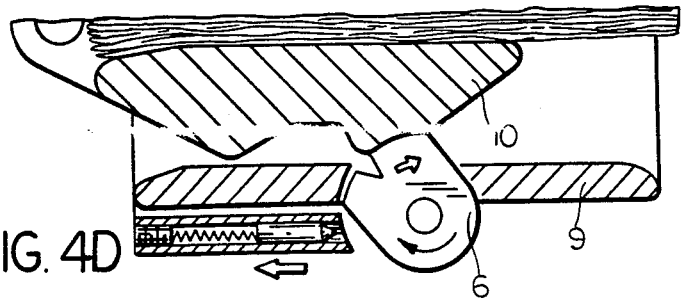
Figure 4E:
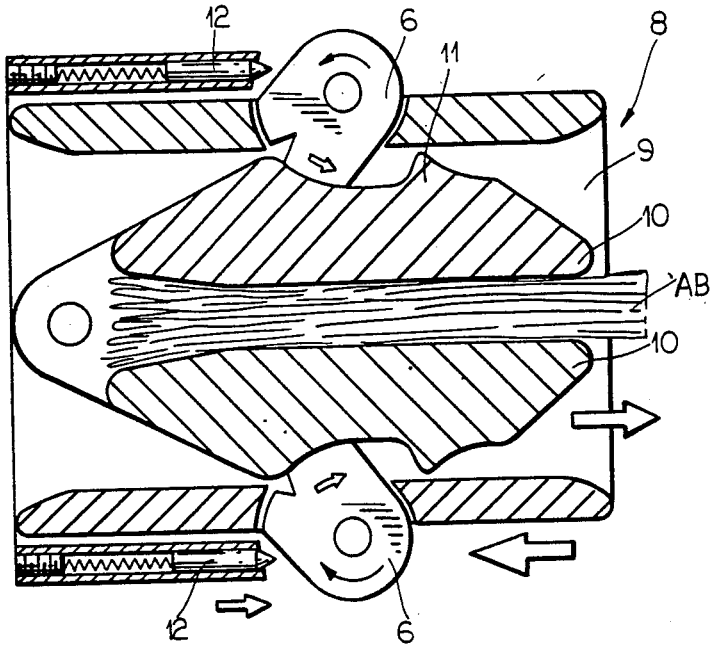
Figure 4F:
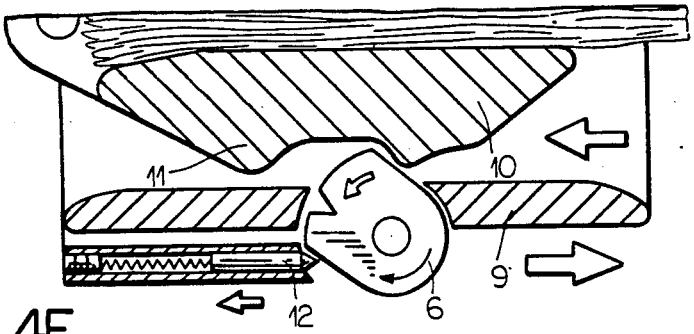
Figure 4G:
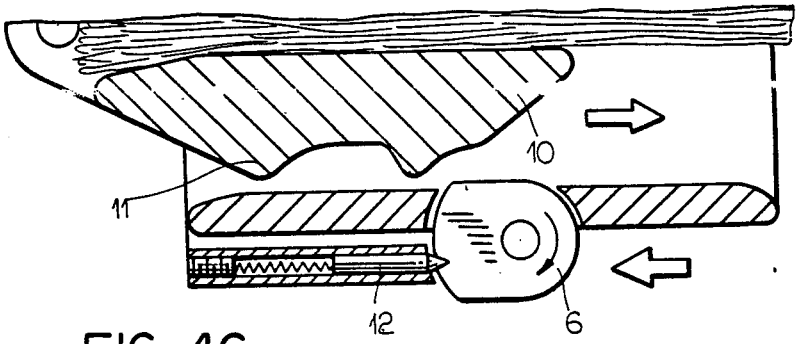

FIG. 4A and 4B show various conditions a to g of a cable tensioner 8 according to the invention, which is provided with a housing 9 in which pivotal cable biasing means 10 are mounted. The cable biasing means 10 have one or more cams 11, against which the spring pawl 6 is each time arrested before they are released, which can happen by remote control. The cable tensioner 9 is further provided with a lock 12 by which the spring pawl 6 is to be rendered inoperative.

The pretensioner acts in the first instance to tension the chain. The pretensioner can also be used in deep water, without removing the pretensioner again. In the latter case the danger exists that the chain will continuously be tensioned again and that the forces are inadvertently increased. Thereto a tension limiting means 21–38 as illustrated in FIG. 5 is designed, which after pretensioning at the desired tension will block the passage of the chain in direction p. To accomplish this, links 21 and 22 are added to the pretensioner 8. When pulling on chain 26, point 24 and 25 tend to pull point 23 in one extended line. This is stopped by a pack of belleville spring washers 27. When exceeding the spring pressure, blade 28 of link 21 and blade 29 of link 22 will be pulled apart. Pawl 30 is then released from arm 31. A spring 32 will turn shaft 33 90°, whereby the blocking 34 of pin 35 is released. At the same time by pawl 36 a smok buoy will be released and float up to the surface of the the sea. This is the signal to lower the pretensioner. The tensioner on the chain 26 will disappear and pin 25 will now be pressed out by the spring 37. Also the pawl 38 is released and has blocked by means of a spring the return p of the chain 39. It is illustrated by FIG. 5 that when chain 39 is hauled by means of the wire 40 to the ship, the pretensioner will not slip down the chain.

Figure 5A:
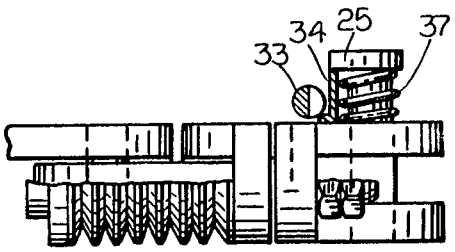
FIG. 5 and 5A represent a tension limiting means for a pretensioner.
Figure 5:
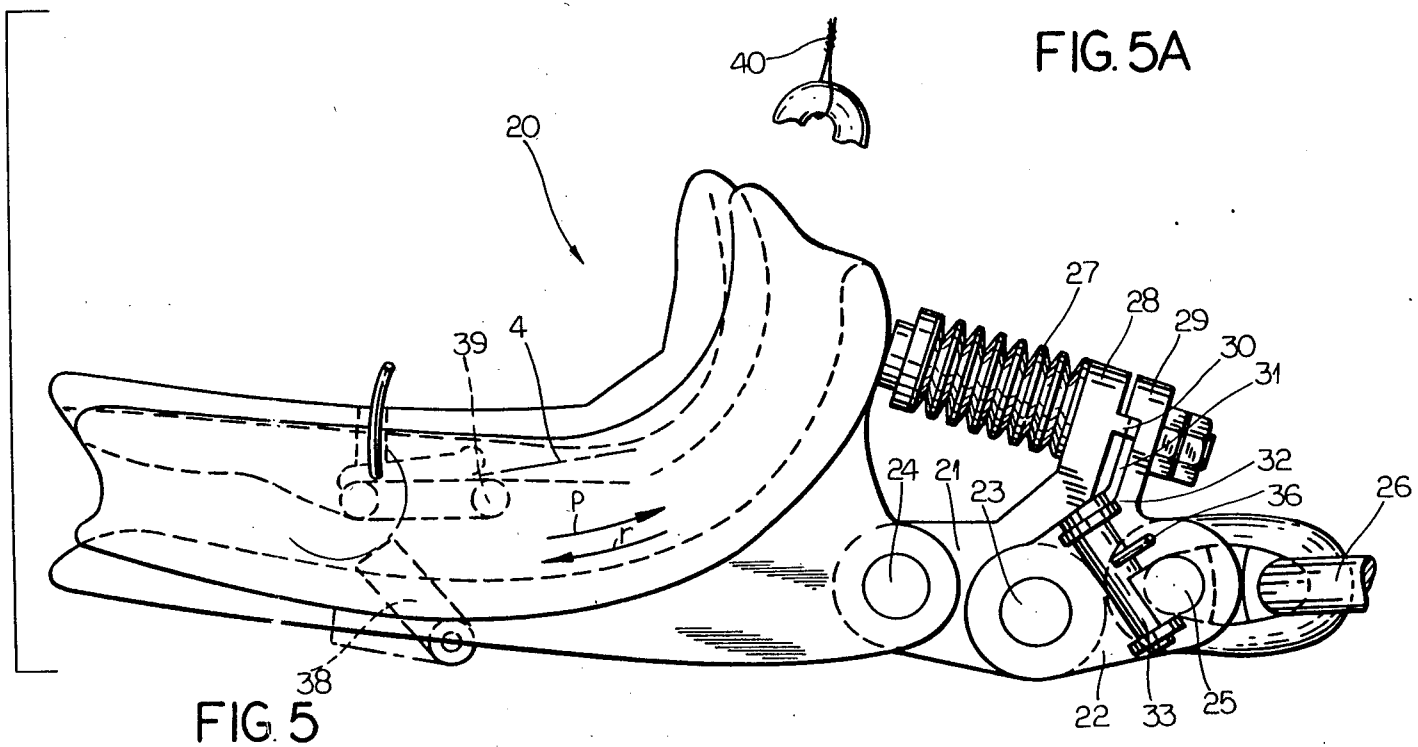

FIG. 5A shows the spring disconnected for tensioning-in the chain.

Finally it is observed that what is described here in the foregoing is only intended for illustrative purposes and should not be interpreted in a restrictive sense as modifications and other embodiments are possible within the scope of the invention. Thus, for example, the cable line could be run through the two anchors on cable rollers in the anchor eyes, whereby the pulling angle could be halved and the pulling force be doubled when testing anchors.

I claim:

1. In an arrangement for tensioning a first anchor line, the arrangement having:

said first anchor line with a first end of said first anchor line connected to a first anchor for anchoring to the bed of a body of water, said first anchor line being for tensioning by hauling an opposite, second end of said first anchor line in a direction away from said first end of said first anchor line;

a device through which said first anchor line extends; and at least one second anchor line having a first end connected to a second anchor for anchoring to said bed of said body of water at a distance from said first anchor and a second, opposite end connected to said device, the improvement wherein:

the device comprises one-way means for passing the first anchor lie therethrough in said direction for said tensioning of said first anchor line and for blocking the passage of said first anchor line therethrough in the opposite, tension-relieving direction of said first anchor line.

2. The arrangement of claim 1, wherein said device comprises a curved tube thru which said first anchor line has been placed.

3. The arrangement of claim 1, wherein said one way means comprises a spring pawl, said first anchor line being a chain.

4. In a method for tensioning a first anchor line having a first end of said first anchor lie connected to a first anchor for anchoring to the bed of a body of water by hauling an opposite, second end of said first anchor line in a direction away from said first end of said first anchor line, said first anchor line extending through a device, and at least one second anchor line having a first end connected to a second anchor for anchoring to said bed of said body of water at a distance from said first anchor and a second, opposite end connected to said device, the improvement comprising:

passing the first anchor line through the device in said direction for said tensioning of said first anchor line and blocking the passage of said first anchor line therethrough in the opposite, tension-relieving directon of said first anchor line.

* * * * *